US008777226B1

(12) United States Patent
Decker, Jr.

(10) Patent No.: US 8,777,226 B1
(45) Date of Patent: Jul. 15, 2014

(54) PROXY TARGET SYSTEM

(71) Applicant: Robert Hubert Decker, Jr., Orange, CA (US)

(72) Inventor: Robert Hubert Decker, Jr., Orange, CA (US)

( * ) Notice: Subject to any disclaimer, the term of this patent is extended or adjusted under 35 U.S.C. 154(b) by 88 days.

(21) Appl. No.: 13/736,737

(22) Filed: Jan. 8, 2013

Related U.S. Application Data

(60) Provisional application No. 61/662,725, filed on Jun. 21, 2012.

(51) Int. Cl.

| | |
|---|---|
| ***F41J 7/06*** | (2006.01) |
| ***F41J 5/18*** | (2006.01) |
| ***F41J 5/14*** | (2006.01) |
| ***F41J 9/00*** | (2006.01) |

(52) U.S. Cl.
CPC .... *F41J 9/00* (2013.01); *F41J 5/18* (2013.01); *F41J 5/14* (2013.01)
USPC ..... 273/406; 463/2; 434/11

(58) Field of Classification Search
USPC ..... 273/371, 403–410, 440.1, 453, 454; 434/11, 16; 463/2, 5
See application file for complete search history.

(56) References Cited

U.S. PATENT DOCUMENTS

| | | | | |
|---|---|---|---|---|
| 4,680,012 | A * | 7/1987 | Morley et al. | 434/22 |
| 4,772,028 | A * | 9/1988 | Rockhold et al. | 463/5 |
| 4,934,937 | A | 6/1990 | Judd | |
| 5,177,872 | A * | 1/1993 | Lewis et al. | 33/366.16 |
| 5,215,464 | A * | 6/1993 | Marshall et al. | 434/22 |
| 5,320,358 | A | 6/1994 | Jones | |
| 5,599,187 | A * | 2/1997 | Mesiano | 434/19 |
| 5,913,727 | A * | 6/1999 | Ahdoot | 463/39 |
| 5,980,254 | A | 11/1999 | Muehle et al. | |
| 6,863,609 | B2 * | 3/2005 | Okuda et al. | 463/36 |
| 7,646,372 | B2 * | 1/2010 | Marks et al. | 345/156 |
| 7,791,808 | B2 | 9/2010 | French et al. | |
| 7,874,918 | B2 * | 1/2011 | Osnato et al. | 463/36 |
| 7,900,927 | B1 | 3/2011 | Bliehall | |
| 7,963,833 | B2 * | 6/2011 | Novak et al. | 463/2 |
| 8,205,888 | B2 * | 6/2012 | Deatherage, Jr. | 273/405 |
| 8,287,373 | B2 * | 10/2012 | Marks et al. | 463/36 |
| 8,514,255 | B2 * | 8/2013 | Kami et al. | 345/680 |
| 2003/0017872 | A1 * | 1/2003 | Oishi et al. | 463/33 |
| 2003/0032466 | A1 * | 2/2003 | Watashiba | 463/2 |
| 2004/0146840 | A1 * | 7/2004 | Hoover et al. | 434/21 |
| 2007/0015116 | A1 | 1/2007 | Coleman | |
| 2010/0273130 | A1 * | 10/2010 | Chai et al. | 434/20 |
| 2010/0277411 | A1 | 11/2010 | Yee et al. | |
| 2011/0009241 | A1 | 1/2011 | Lane et al. | |
| 2012/0156652 | A1 * | 6/2012 | Lane et al. | 434/11 |

* cited by examiner

*Primary Examiner* — Mark Graham
(74) *Attorney, Agent, or Firm* — One3 IP Management, P.C.; Justin G. Sanders

(57) ABSTRACT

A proxy target system provides, in the exemplary embodiment, a plurality of cover barriers and proxy barriers. Each cover barrier is sized and configured for allowing at least one shooter to selectively take cover therebehind. Each proxy barrier is associated with a corresponding one of the cover barriers. Each of the cover barriers provides a means for tracking the associated shooter when positioned therebehind. Relatedly, each of the proxy barriers provides an at least one target positioned therebehind and configured for mimicking the movement and exposure of the shooter relative to the associated cover barrier. Thus, with the proxy barriers positioned a distance downrange from the corresponding cover barriers, two or more shooters may position themselves behind respective cover barriers and engage in a shootout with one another by shooting at each other's downrange targets rather than directly at one another, thereby eliminating any risk of injury or death.

20 Claims, 4 Drawing Sheets

PROXY TARGET SYSTEM

RELATED APPLICATIONS

This application claims priority and is entitled to the filing date of U.S. Provisional application Ser. No. 61/662,725, filed on Jun. 21, 2012 and entitled, "Proxy Target System." The contents of the aforementioned application are incorporated by reference herein.

INCORPORATION BY REFERENCE

Applicant hereby incorporates herein by reference any and all U.S. patents and U.S. patent applications cited or referred to in this application.

BACKGROUND OF THE INVENTION

1. Field of the Invention

Aspects of this invention relate generally to systems for shooting practice, and more particularly to a proxy target system configured for allowing two or more persons to engage in a shootout with one another without any risk of injury or death.

2. Description of Related Art

By way of background, shooting ranges provide environments in which users can be trained in the use of weapons or can refine weapons use skills. At such shooting ranges, users may train with conventional firearms, such as pistols and rifles, or may sometimes even use a variety of alternative weapons, such as bows and arrows. Regardless of the types of weapons used, shooting ranges typically include a shooting zone in which the shooter is positioned. The shooter then projects some form of projectile from the shooting zone toward a target positioned downrange in a target zone. For example, a shooter may fire a pistol from a shooting zone toward a "bull's-eye" paper target. Similarly, a participant may fire arrows from a shooting zone toward a pin cushion-type target.

To improve the realism of the weapons familiarization process and to provide a more lifelike experience, a variety of approaches have been suggested to make shooting ranges more realistic. For example, some shooting ranges provide paper targets with threatening images, rather than "bull's-eye" targets. In attempts to present a more realistic scenario to the shooter, in order to provide an interactive and immersive experience, some shooting ranges have replaced such fixed targets with animated video images, typically projected onto a display screen; the animated images presenting moving targets and/or simulated return threats toward which the shooter fires.

While such approaches may provide improved visual approximations of actual situations, as compared to stationary paper targets, these approaches lack any threat of retaliation. A participant is, thus, less likely to react in a realistic fashion. Furthermore, such animated video images, while providing the shooter with moving targets, are nevertheless typically incapable of providing the level of unpredictability and improvised behavior that a live target, be it human or animal, can provide. For obvious reasons, shooters cannot practice shooting at live, human targets using lethal weapons, given the extremely high risk of injury or death it would create.

Rather than limiting themselves to the unrealistic experiences of shooting at simulated targets, some shooters choose to engage in simulated combat or similar experiences with other shooters, through combat games that utilise non-lethal projectiles, such as light beams, paintballs, or pellets. However, while use of such non-lethal weapons allows two or more live persons to engage in simulated combat—thus, providing the types of unpredictable, improvised targets that traditional target-based shooting ranges have been unable to provide—it does not allow the shooters to experience the use of actual lethal weapons and/or live ammunition in such situations; including the weight, the process of re-loading, the ballistics, the trigger resistance or trigger pull, and the associated recoil when firing such weapons. Thus, even these simulated combat alternatives are still, in many respects, unrealistic experiences.

The following art defines the present state of this field:

U.S. Pat. No. 4,934,937 to Judd is generally directed to a system for training soldiers in the use of firearms under simulated combat conditions having an enemy representative target and a simulating enemy firearm fire generator to arrest simulated enemy fire in response to the target being shot with a round of live ammunition.

U.S. Pat. No. 5,320,358 to Jones is generally directed to a shooting game that includes programmable flip-up targets spaced along a game course, and sensors associated with the targets that detect the presence of a player near the associated target. A programmable main controller transmits skill level control instructions to each of the target controllers. The target controllers cause the targets to fire paint balls or other items at the player in accordance with the selected skill level. The game may be played indoors or outdoors by one or more players.

U.S. Pat. No. 5,980,254 to Muehle et al. is generally directed to a weapons training range that provides a simulated weapons use scenario including return fire. A microprocessor selects branches from a multi-branch program and causes an image projector to project subscenarios on a display screen visible to a participant. In response to the subscenarios, the participant fires at projected threats. Return fire simulators positioned behind the display screen return fire toward the participant. Obstructions are placed in the weapons range to provide cover for the participant. A video camera and X-Y position sensor identify the X-Y location of the participant and try to detect exposed portions of the participant. Based upon the identified X-Y location and any detected exposed portions, the microprocessor aims the return fire simulators to provide simulated return fire. To simulate real world aiming, the microprocessor induces time-based and response-based aiming errors. Additionally, the microprocessor may aim the return fire simulators at objects in the participation zone to produce deflected fire that may also strike the participant.

U.S. Patent Application Publication No. 2007/0015116 to Coleman is generally directed to a method of and apparatus for virtual shooting practice comprising a displayed shooting practice image including a target portion and a simulated gun. As the target portion of the image moves relative to the remainder thereof, the simulated gun is moved relative to the displayed image and relative to the moving target portion. Movement of the simulated gun is compared with the movement of the target portion of the displayed image resulting in a determination of whether a "shot" from the gun is a "hit" or a "miss".

U.S. Pat. No. 7,791,808 to French et al. is generally directed to a system and method for tracking and assessing movement skills in multidimensional space. Accurate simulation of sport to quantify and train performance constructs by employing sensing electronics for determining, in essentially real time, the player's three dimensional positional changes in three or more degrees of freedom (three dimensions); and computer controlled sport specific cuing that evokes or prompts sport specific responses from the player that are measured to provide meaningful indicia of performance. The sport specific cuing is characterized as a virtual opponent that is responsive to, and interactive with, the player in real time. The virtual opponent continually delivers and/or responds to stimuli to create realistic movement challenges for the player U.S. Patent Application Publication No. 2010/0277411 to Yee et al. is generally directed to user tracking feedback for providing feedback to a user on an ability of an executing application to track user action for control of the executing application on a computer system. A capture system detects a user in a capture area. Factors in the capture area and the user's actions can adversely affect the ability of the application to determine if a user movement is a gesture which is a control or instruction to the application. One example of such factors is a user being out of the field of view of the capture system. Some other factor examples include lighting conditions and obstructions in the capture area. Responsive to a user tracking criteria not being satisfied, feedback is output to the user. In some embodiments, the feedback is provided within the context of an executing application.

U.S. Patent Application Publication No. 2011/0009241 to Lane et al. is generally directed to a virtual locomotion controller apparatus and methods that combine data obtained from various sensor devices to allow users to control the movements of their representation in a virtual world using sensorimotor responses closely resembling the tasks and actions they would physically perform in the real world. As a result, users can specify an avatar's locomotion style by assuming body postures normally associated with that type of movement, while controlling locomotion speed or displacement through foot forces and/or stepping motions and locomotion direction through foot and body orientation.

U.S. Pat. No. 7,900,927 to Bliehall is generally directed to a small arms training target system including a portable, battery powered, rail guided, motor driven carriage, with stationary and moving targets connected thereto. A target-rotate control device operatively connects an electric motor and rotational arm assembly to rotate and position the target into and out of a field of view. The position is selectable by a remote control, pre-selected program, or when a sensor attached to the target is struck by a sensor. Additionally an obscuring medium is attached to the rotational arm, with a target, having on it an image of a weapon mounted behind the obscuring medium. The position of the obscuring medium is selectable to be in front of the image of a weapon, making the target a no-threat, or not in front of the target, making it a threat.

Thus, the prior art described above teaches systems that essentially provide shooters with two options, both being less than ideal: practice shooting using real, lethal weapons, but at simulated targets; or practice shooting at real, live targets, but using simulated, non-lethal weapons. Aspects of the present invention are directed to solving these problems and provide further related advantages as described in the following summary.

SUMMARY OF THE INVENTION

Aspects of the present invention teach certain benefits in construction and use which give rise to the exemplary advantages described below.

The present invention solves the problems described above by providing a proxy target system configured for allowing two or more persons to engage in a shootout with one another using lethal weapons and live ammunition without any risk of injury or death, as discussed in detail below. The system provides, in the exemplary embodiment, a plurality of cover barriers and a corresponding number of proxy barriers. Each cover barrier is sized and configured for allowing at least one person (hereinafter referred to as a "shooter") to selectively take cover therebehind. Each proxy barrier is associated with, and positioned a distance away from, a corresponding one of the cover barriers. Each of the cover barriers provides a means for tracking and determining if and when the associated at least one shooter, when positioned behind the cover barrier, should move part or all of his body out from behind the cover barrier. Relatedly, each of the proxy barriers provides an at least one target positioned therebehind and configured for mimicking the movement and exposure of the at least one shooter relative to the associated cover barrier behind which the shooter is positioned. Thus, with the proxy barriers positioned a distance downrange from the corresponding cover barriers, two or more shooters may position themselves behind respective cover barriers and engage in a shootout with one another by shooting at each other's downrange targets rather than shooting directly at one another, thereby eliminating any risk of injury or death to the shooters.

A primary objective inherent in the above described system and method of use is to provide advantages not taught by the prior art.

Another objective is to provide such a system configured for allowing two or more participants to engage in a shootout with one another without any risk of injury or death, in accordance with at least one embodiment.

A further objective is to provide such a system that allows two or more participants to optionally use real, lethal weapons and live ammunition, in accordance with at least one embodiment.

A still further objective is to provide such a system that utilizes proxy targets configured for mimicking the movements and behaviors of the associated participants, in accordance with at least one embodiment.

A still further objective is to provide such a system that allows participants to engage in a shootout with one another either locally or remotely, in accordance with at least one embodiment.

Other features and advantages of aspects of the present invention will become apparent from the following more detailed description, taken in conjunction with the accompanying drawings, which illustrate, by way of example, the principles of aspects of the invention.

BRIEF DESCRIPTION OF THE DRAWINGS

The accompanying drawings illustrate aspects of the present invention. In such drawings.

The above described drawing figures illustrate aspects of the invention in at least one of its exemplary embodiments, which are further defined in detail in the following description. Features, elements, and aspects of the invention that are referenced by the same numerals in different figures represent the same, equivalent, or similar features, elements, or aspects, in accordance with one or more embodiments.

DETAILED DESCRIPTION OF THE INVENTION

The above described drawing figures illustrate aspects of the invention in at least one of its exemplary embodiments, which are further defined in detail in the following description.

Figure 1:
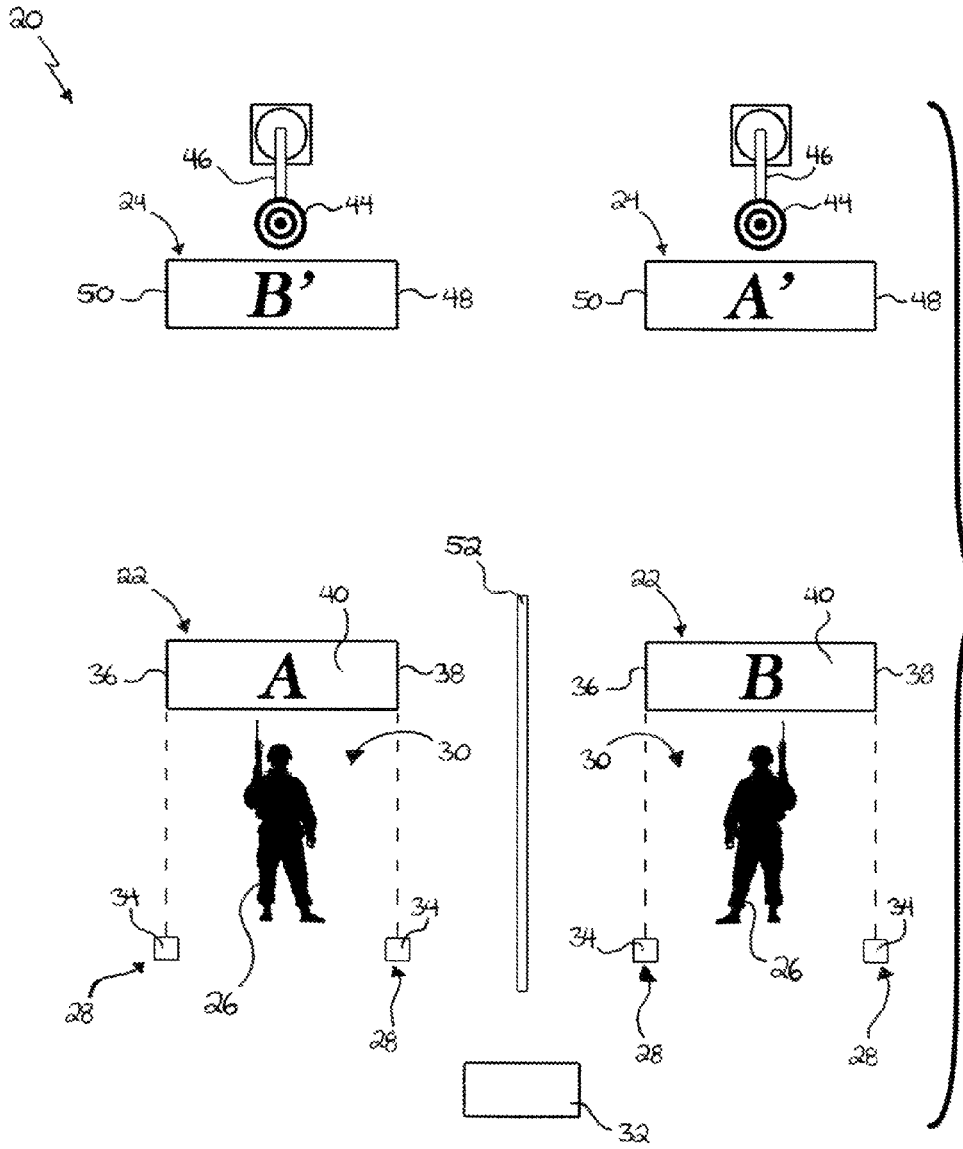
FIG. 1 is a top schematic view of an exemplary proxy target system, in accordance with at least one embodiment.

Turning now to FIG. 1, there is shown a top schematic view of an exemplary proxy target system 20, in accordance with at least one embodiment. The system 20 comprises, in the exemplary embodiment, a plurality of cover barriers 22 and a corresponding plurality of proxy barriers 24 positioned a distance away from the respective cover barriers 22. Each cover barrier 22 is preferably sized and configured for allowing an at least one individual participant (hereinafter referred to simply as a shooter 26) to selectively take cover therebehind. For simplicity purposes in describing the details of the present invention, the shooters 26 are described in the context of being male; however, in use, the shooters 26 can obviously be either male or female. Each proxy barrier 24 is preferably of the same dimensions as the corresponding cover barrier 22, the purpose of which is explained further below. It should be noted, however, that the cover barriers 22 and proxy barriers 24 may each take on any size or shape desired to suit the particular context in which the system 20 is to be used, so long as they are capable of substantially carrying out the functionality herein described. In the exemplary embodiment, the system 20 provides a single cover barrier 22 and corresponding proxy barrier 24 for each shooter 26. In further embodiments, the system 20 provides multiple cover barriers 22 and corresponding proxy barriers 24 for each shooter 26. In still further embodiments, not shown, each cover barrier 22, and its corresponding proxy barrier 24, provides an at least one opening positioned and configured for allowing the shooter 26 to look therethrough, much like a window. Preferably, each of the cover barriers 22 and proxy barriers 24 are constructed out of bullet-proof or similar materials capable of withstanding repeated gunfire. However, in further embodiments, the cover barriers 22 and proxy barriers 24 are constructed out of non-bullet-proof materials, including transparent or semi-transparent materials, as well as natural materials such as bushes or dirt berms. In still further embodiments, each of the cover barriers 22 and/or proxy barriers 24 is capable of selectively moving or travelling a distance across range.

With continued reference to FIG. 1, each of the cover barriers 22 provides an at least one sensor 28 configured for forming a detection grid 30 behind said cover barrier 22. In a bit more detail, the sensor 28 is configured for detecting if and when the shooter 26, when positioned behind the cover barrier 22, should move part or all of his body out from behind the cover barrier 22 (including through an opening in the cover barrier 22, where provided). In the exemplary embodiment, the sensor 28 is in communication (wired or wireless) with an automated controller 32 configured for receiving signals from the sensor 28 related to the position of the shooter 26 relative to the cover barrier 22. As such, the controller 32 is capable of monitoring the position of each shooter 26, relative to his respective cover barrier 22, and determining if and when each shooter 26 should expose part or all of his body out from behind his respective cover barrier 22. It should be noted that while the controller 32 is shown in the drawings as being positioned behind the cover barriers 22, in further embodiments, the controller 32 may be positioned anywhere else—such as behind the proxy barriers 24 or even remote from the barriers 22 and 24—so long as the controller 32 is capable of substantially carrying out the functionality herein described. It should also be noted that the controller 32, while shown in the drawings as a single, self-contained unit, may comprise a plurality of separate units and/or components in further embodiments. In still further embodiments, the controller 32 is omitted altogether, with each of the components of the system 20 simply being in direct communication (wired or wireless) with one another as appropriate.

In one embodiment, illustrated in FIG. 1, the sensor 28 comprises a pair of motion sensors 34, similar to photo-electric or photo-reflective sensors used in connection with garage doors. However, in further embodiments, the at least one sensor 28 may comprise other types of motion detectors, infrared beams, and similar devices, now known or later developed, that could be used to detect and monitor the position of the shooter 26 relative to his cover barrier 22. With continued reference to the embodiment shown in FIG. 1, the motion sensors 34 are preferably positioned a distance behind the cover barrier 22, such that the shooter 26 is positioned between the cover barrier 22 and the motion sensors 34. Additionally, in such embodiments, the motion sensors 34 are preferably aligned with opposing left and right sides 36 and 38 of the cover barrier 22 so as to better detect when the shooter 26 might move out from behind the cover barrier 22, thereby passing directly in front of one of the motion sensors 34. In further such embodiments, not shown, additional sensors 28 may be similarly positioned to detect if and when the shooter 26 should expose himself over a top 40 of, or underneath, the cover barrier 22. Similarly, where the cover barrier 22 provides an opening, a further pair of motion sensors 34 is preferably positioned and aligned with opposing right and left sides of said opening so as to better detect when the shooter 26 might expose himself therethrough.

Figure 2:
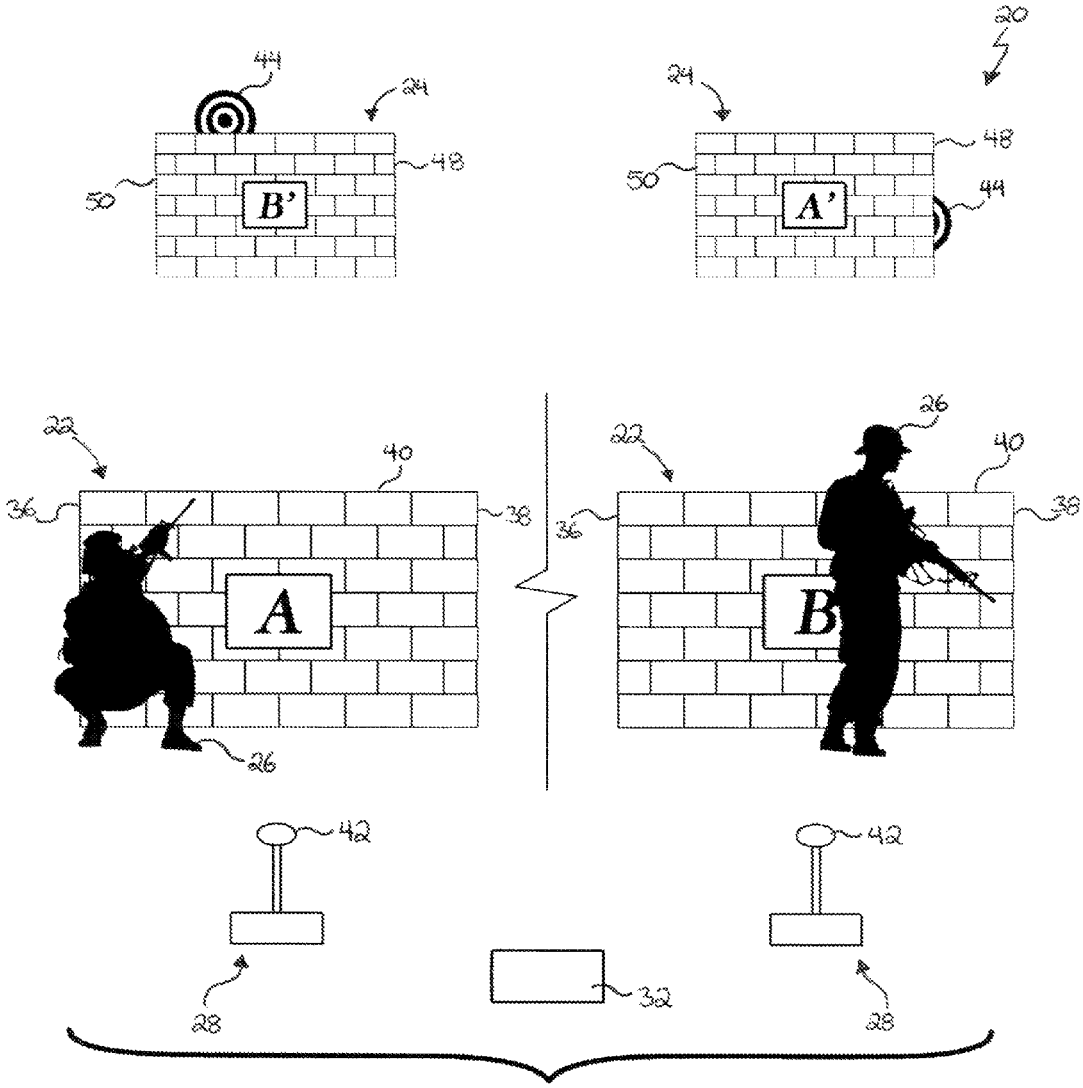
FIGS. 2 and 3 are perspective views of further exemplary proxy target systems, in accordance with at least one embodiment.
Figure 3:
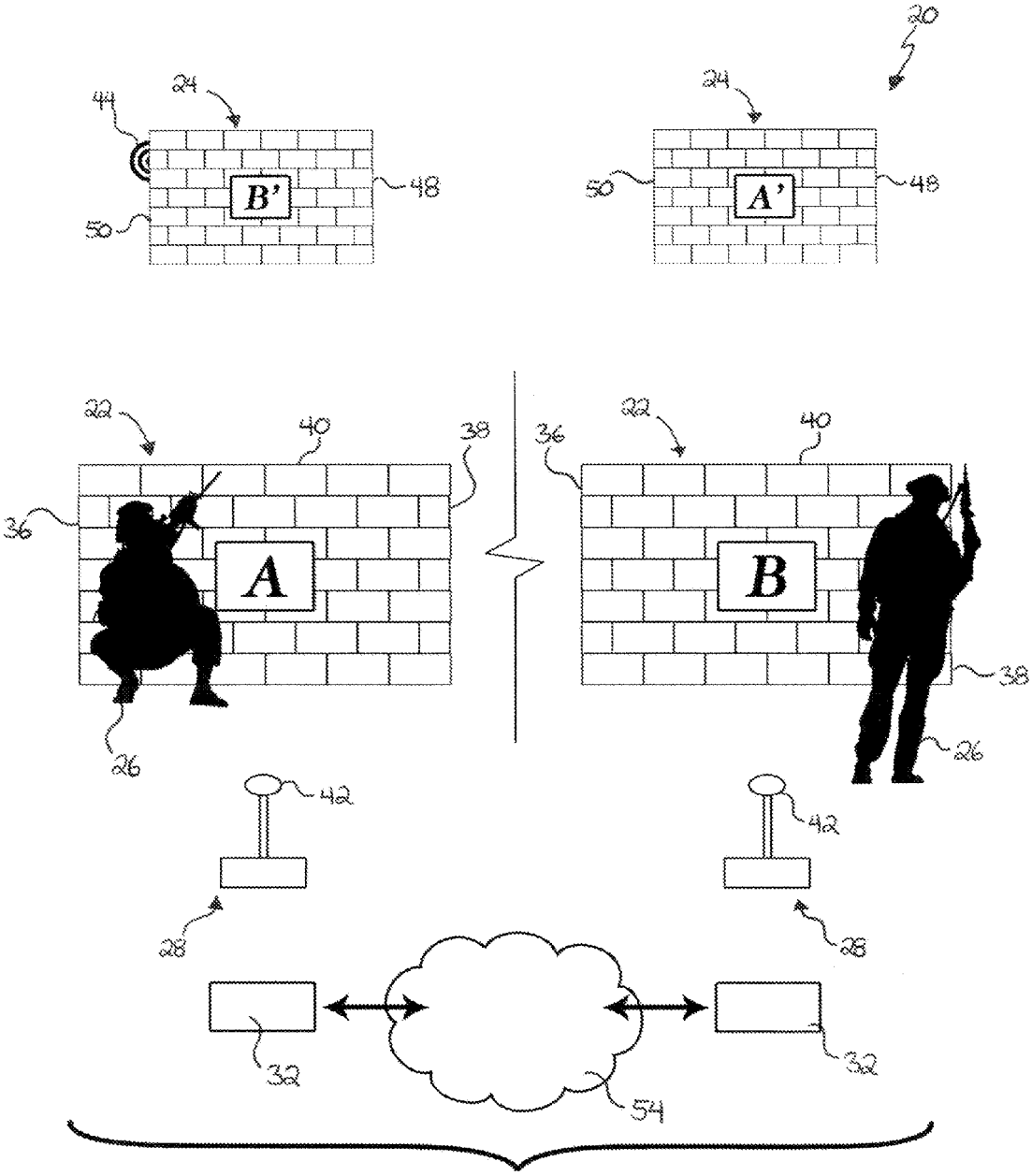

In still further embodiments, as illustrated in FIGS. 2 and 3, the sensor comprises an at least one optical sensor 42, such as a camera, configured for tracking and more accurately detecting the shooter's 26 movements in three dimensions as well as any exposure from behind the cover barrier 22 or through an opening, where provided. In other words, rather than simply detecting if and when the shooter 26 may expose himself around the left or right side 36 or 38 of the cover barrier 22, or through an opening, the controller 32 is further able to detect whether the shooter 26 is in a prone position, crouching position, standing position, etc. Similarly, rather than simply detecting if and when the shooter 26 may expose himself over the top 40 of the cover barrier 22, the controller 32 is further able to detect the lateral position of the shooter 26 relative to the cover barrier 22 (i.e., top-right, top-center, top-left, etc.). In such an embodiment, the optical sensor 42 is preferably similar to that shown and described in U.S. Patent Application Publication No. 2010/0277411, which is hereby incorporated by reference.

In still further embodiments, not shown, the sensor 28 comprises at least one optical sensor configured to be worn on the shooter 26 (preferably at or near the shooter's forehead or center mass), or on the gun of the shooter 26, and a plurality of infrared LED's positioned a distance behind the cover barrier 22, such that the shooter 26 is positioned between the cover barrier 22 and the LED's. The interoperability between the optical sensor and LED's, enabling the controller 32 to determine and track the shooter's 26 position through triangulation, is similar to the equipment and methods shown and described in U.S. Patent Application Publication Nos. 2007/0060384, 2007/0211026, and 2007/0211027, each of which is hereby incorporated by reference.

It should be noted that still further embodiments may incorporate any number, type, or relative positions of sensors 28, now known or later developed, so long as the sensors 28 are able to substantially carry out the functionality herein described. Thus, the above described embodiments should not be read as limiting the present invention in any way, shape or form. It should also be noted that, in embodiments where the cover barriers 22 are capable of selectively moving or travelling a distance across range, the associated sensors 28 are similarly capable of selectively moving in tandem with the cover barriers 22.

Figure 4:
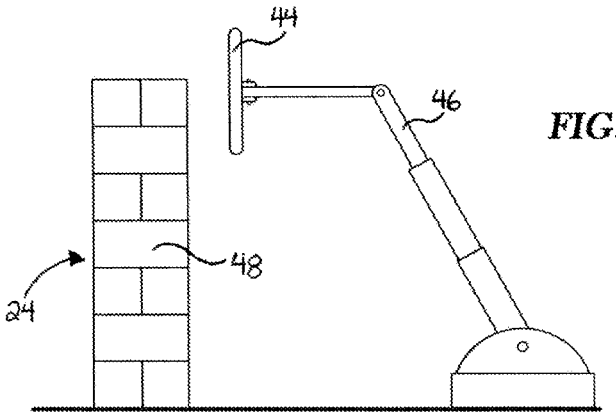
FIG. 4 is a side view of an exemplary proxy barrier and target, in accordance with at least one embodiment.

Referring again to FIG. 1, each of the proxy barriers 24 provides an at least one target 44 positioned therebehind and configured for moving between an exposed/visible position, wherein at least a portion of the target 44 is visible (FIG. 2), and a hidden position, wherein the entire target 44 is positioned behind the proxy barrier 24 (FIG. 1). It should be noted that the respective shape, size and material of each target 44, and even number of targets 44, should not be read as being limited to only those shown in the drawings; but rather, in further embodiments, each target 44 may be any shape, size or material of construction desired to suit the particular context in which the system 20 is to be used. Furthermore, in at least one embodiment, where more than one shooter 26 is positioned behind a single cover barrier 22 (such as when teams of shooters 26 are participating), the associated proxy barrier 24 provides a corresponding number of targets 44 positioned therebehind—each shooter 26 behind the cover barrier 22 essentially having their own corresponding target 44 positioned behind the associated proxy barrier 24. In at least one such embodiment, each of the targets 44 is configured for indicating the relative threat, priority level or armaments (i.e., assault rifle or other relatively "high threat" weapons vs. pistols or other relatively "low threat" weapons) of the shooter 26 associated with said target 44, such that the at least one opposing shooter 26 is able to visually differentiate the threats accordingly. This may be accomplished through each respective target 44 being of a different color, shape or size, or through any other means, now known or later developed, capable of indicating the relative threat of each associated shooter 26. Movement of the target 44 is accomplished, in at least one embodiment, using common mechanical components—i.e., solenoids, air valves, single action air cylinders, double action air cylinders, non-rotating air cylinders, rodless air cylinders, linear electric drives, etc.—capable of selectively moving the target 44 between exposed and hidden positions as well as varying degrees of exposure (ranging from part to all of the target 44) while in the exposed position. In an exemplary embodiment, shown in FIG. 4, the target 44 is pivotally engaged with a rotatable, articulating, telescoping arm 46 configured for selectively moving the target 44 between exposed and hidden positions. In further embodiments, any means for moving the target 44, now known or later developed, capable of substantially carrying out the functionality herein described, may be substituted.

In the exemplary embodiment, each target 44—or at least the means for moving each target 44—is in communication (wired or wireless) with the controller 32. The controller 32 is configured for selectively causing the targets 44 to move between the exposed and hidden positions, depending on the signals being received from the respective sensors 28. In other words, with a shooter 26 positioned behind one of the cover barriers 22, should the shooter 26 move part or all of his body out from behind the cover barrier 22, or through an opening where provided, the sensor 28 detects such exposure and sends an appropriate exposure signal to the controller 32. Upon receiving the exposure signal, the controller 32 then causes the appropriate target 44 of the corresponding proxy barrier 24 to move into an appropriate exposed position so as to mimic the position and amount of the shooter's 26 body that is exposed from behind the cover barrier 22. For example, as illustrated in FIG. 2, if the shooter 26 exposes himself around the left side 36 of the cover barrier 22, the target 44 of the corresponding proxy barrier 24 is exposed around a left side 48 of the proxy barrier 24. As soon as the shooter 26 takes cover once again behind the cover barrier 22 (FIG. 3), or if the shooter 26 moves outside of the detection grid 30 behind the cover barrier 22, the target 44 moves back into the hidden position behind the proxy barrier 24. In some embodiments, the sensors 28 and corresponding targets 44 are capable of tracking and mimicking the shooter's 26 exposure from only the left and right sides 36 and 38 of the cover barrier 22. In other embodiments, the sensors 28 and corresponding targets 44 are capable of tracking and mimicking the shooter's 26 exposure from anywhere around the cover barrier 22—i.e., around the left side 36 (FIG. 2) or right side 38 (FIG. 3) of the cover barrier 22, over the top 40 of the cover barrier 22 (FIG. 2), underneath the cover barrier 22, or even through an opening in the cover barrier 22. In still further such embodiments, where the sensor 28 is capable of detecting the shooter's 26 movements in three dimensions as described above, the controller 32 is able to detect whether the shooter 26 is in a prone or crouching position (thus, for example, causing the appropriate proxy target 44 to be exposed around the low left side 48 of the proxy barrier 24, as shown in FIG. 2), in a standing position (thus, for example, causing the appropriate proxy target 44 to be exposed around a high right side 50 of the proxy barrier 24, as shown in FIG. 3), etc. In still further such embodiments, the sensor 28 is also capable of detecting the distance between the shooter 26 and the cover barrier 22 and, as such, the controller 32 is capable of causing the appropriate target 44 to be positioned the same distance away from the corresponding proxy barrier 24, as shown in FIG. 3. Thus, for example, in such embodiments, the further away the shooter 26 is positioned behind the cover barrier 22, the further away the target 44 is positioned behind the corresponding proxy barrier 24. In alternate embodiments, where the system 20 does not comprise a controller 32, the sensors 28 are in direct communication (wired or wireless) with each target 44—or at least the means for moving each target 44.

In this way, as illustrated in FIG. 2, with the proxy barriers 24 positioned a distance downrange from the corresponding cover barriers 22, two or more shooters 26—or teams of shooters 26—may position themselves side-by-side behind respective cover barriers 22 yet still engage in a shootout with one another by shooting at each other's downrange proxy targets 44 rather than shooting directly at one another. Because of this, lethal weapons and live ammunition may be used so as to simulate real-world firelight conditions without any risk of injury or death to the shooters 26—obviously, though, should the shooters 26 desire, various types of non-lethal weapons and/or ammunition may be used as well. In such embodiments, the proxy barrier 24 of each shooter 26 is preferably positioned directly downrange from the cover barrier 22 of the other shooter 26 so as to allow each shooter 26 to look directly downrange at his opposing shooter's 26 proxy target 44 for creating more of a "head-to-head" scenario. Furthermore, because the targets 44 mimic the movements of their associated shooters 26, looking downrange at a proxy target 44 is tantamount to looking, and shooting, at the opposing shooter 26 himself. In the embodiment illustrated in FIG. 1, the cover barriers 22 are positioned side-by-side with a protective divider wall 52 positioned therebetween; the wall 52 configured for both protecting the shooters 26 from any live fire as well as obscuring their view of one another. In further embodiments, the divider wall 52 may be omitted. In still further embodiments, each of the cover barriers 22 and proxy barriers 24 may be arranged however the shooters 26 may desire in order to suit the particular context in which the system 20 is to be used.

In still further embodiments, the system 20 is operable over a network 54 so as to allow shooters 26 to engage in such simulated firefights remotely with one another. For example, as illustrated in FIG. 3, a first cover barrier A may be positioned in California, while a second cover barrier B is positioned in New York. Additionally, a first proxy barrier A', linked via the network 54 to the first cover barrier A, is positioned in New York, while a second proxy barrier B', linked via the network 54 to the second cover barrier B, is positioned in California. As the shooters 26 move in and out of cover behind their respective cover barriers A and B, those signals are transmitted by the controller 32 via the network 54 to the associated proxy barriers A' and B', respectively, causing the associated targets 44 to move and mimic the position of each shooter 26 substantially in real-time. In such remote scenarios, the system 20 preferably provides separate controllers 32, in remote communication with one another, in each location; at least in one embodiment.

Figure 5:
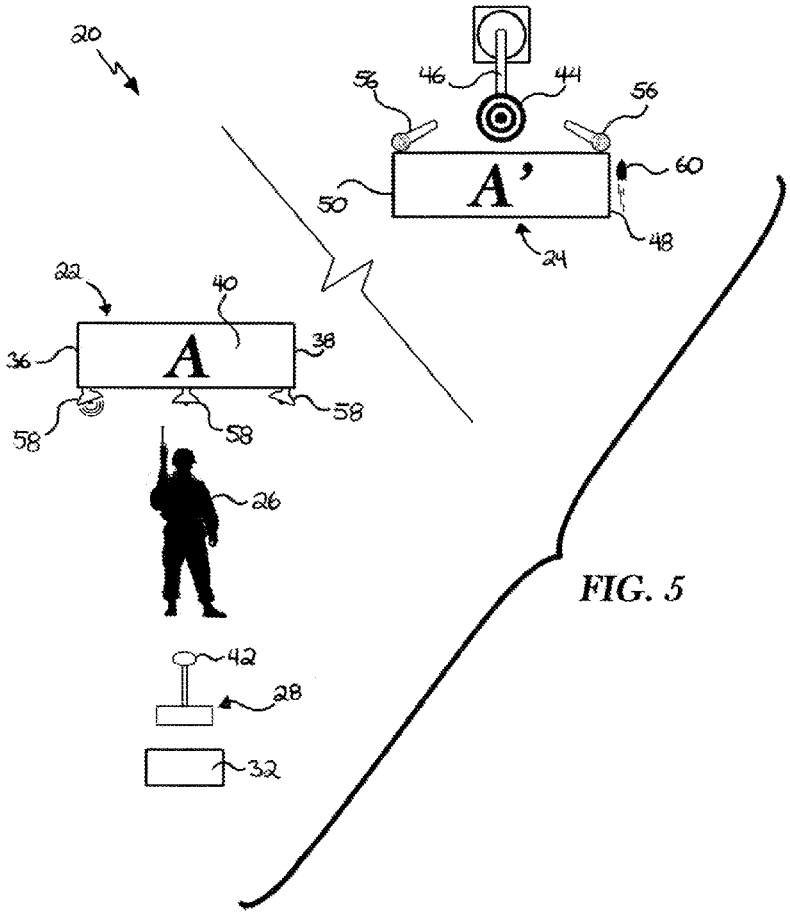
FIG. 5 is a top schematic view of a further exemplary proxy target system, in accordance with at least one embodiment.

In at least one embodiment, illustrated in FIG. 5, the controller 32 is in communication (wired or wireless) with an at least one microphone 56 and an at least one speaker 58; the microphone 56 and speaker 58 configured for allowing each of the shooters 26 to hear any return fire 60 as it impacts or passes near their respective proxy barrier 24. In a bit more detail, each proxy barrier 24 provides at least one microphone 56 positioned therebehind and configured for capturing any sounds created by return fire 60. Additionally, each cover barrier 22 provides at least one speaker 58 positioned therebehind and configured for audibly re-producing, substantially in real-time, any return fire sounds captured by the associated proxy barrier microphone 56. Preferably, each proxy barrier 24 provides a plurality of strategically placed microphones 56 and each cover barrier 22 provides a plurality of strategically placed speakers 58 so as to enable the controller 32 to more accurately capture and re-produce any return fire sounds, allowing the shooters 26 to more accurately determine where, relative to their respective proxy barrier 24, the return fire 60 is directed, in a way that simulates the return fire 60 actually being directed toward the cover barrier 22. For example, with continued reference to FIG. 5, should return fire 60 pass by the left side 48 of the proxy barrier 24, the controller 32 would cause the captured return fire sound to be produced from the left side 36 of the cover barrier 22. This is especially helpful where the shooters 26 are positioned remotely from one another, as it allows the shooters 26 to hear when and where their opponents are firing at them, which helps them to judge when to take cover and when (and where) to expose themselves so as to fire back. It should be noted that, in further such embodiments, any number of microphones 56 and speakers 58, as well as any position and arrangement of said microphones 56 and speakers 58 relative to the proxy barriers 24 and cover barriers 22, respectively, may be substituted in order to suit the particular context in which the system 20 is to be used. In still further embodiments, not shown, each of the cover barriers 22 also provides a microphone 56 positioned and configured for allowing the shooters 26 to communicate with one another, and to allow each shooter 26 to hear the gunfire of the opposing shooter 26 (where the shooters 26 are remotely located from one another). In alternate embodiments, where the system 20 does not comprise a controller 32, the microphone 56 and speaker 58 are in direct communication (wired or wireless) with one another.

In at least one alternate embodiment, not shown, rather than being in communication with an at least one microphone, the controller 32 is in communication (wired or wireless) with an at least one impact plate along with an at least one speaker 58. In such alternate embodiments, each proxy barrier 24 provides at least one impact plate positioned on or near the proxy barrier 24 and configured for sending a signal to the controller 32 upon being struck by a projectile from the opposing shooter 26. Upon receiving such a "hit" signal from the impact plate, the controller 32 causes the speaker 58 positioned behind the associated cover barrier 22 to emit return fire sound effects. Preferably, each proxy barrier 24 provides a plurality of strategically placed impact plates and each cover barrier 22 provides a plurality of strategically placed speakers 58 so as to enable the controller 32 to more accurately re-produce simulated return fire sounds, allowing the shooters 26 to more accurately determine where, relative to their respective proxy barrier 24, the return fire 60 is directed, in a way that simulates the return fire 60 actually being directed toward the cover barrier 22.

In at least one further embodiment, not shown, rather than being in communication with an at least one speaker, the controller 32 is in communication (wired or wireless) with an at least one air gun. In such further embodiments, each cover barrier 22 provides at least one air gun positioned on or near the cover barrier 22 and configured for emitting a burst of air for simulating a projectile either flying past the cover barrier 22 or into the ground proximal the cover barrier 22, depending on the position and configuration of the air gun. Thus, upon the controller 32 detecting return fire 60 directed at the associated proxy barrier 24, the controller 32 causes the air gun to emit an appropriate simulated air blast. Preferably, each cover barrier 22 provides a plurality of strategically placed air guns so as to enable the controller 32 to more accurately re-produce simulated return fire effects, allowing the shooters 26 to more accurately determine where, relative to their respective proxy barrier 24, the return fire 60 is directed, in a way that simulates the return fire 60 actually being directed toward the cover barrier 22.

It should be noted that, in still further embodiments, any other means capable of detecting, simulating or reproducing return fire 60, now known or later developed, may be substituted.

In the exemplary embodiment, the controller 32 is also capable of detecting if and when a target 44 is hit. Preferably, after being hit, the target 44 remains in the exposed position until the associated shooter 26 takes cover behind his cover barrier 22. However, in alternate embodiments, the target 44 automatically moves to the hidden position immediately after being hit. Additionally, in at least one embodiment, the system 20 provides visual and/or audible indicators configured for alerting the shooters 26 when a target 44 has been hit. In one such embodiment, the controller 32 is capable of causing the at least one speaker 58 of the shooter 26 whose target 44 was hit to produce a "hit" sound. In alternate embodiments, where the system 20 does not comprise a controller 32, the target 44 and speaker 58 are in direct communication (wired or wireless) with one another. In further embodiments, not shown, the cover barriers 22 and/or proxy barriers 24 may provide various types of visual indicators, such as lights or flags, configured for being automatically activated upon an associated target 44 being hit. In still further embodiments, not shown, the system 20 provides a scoreboard configured for displaying the respective number of hits for each shooter 26 as tracked by the controller 32.

In at least one embodiment, not shown, the system 20 further provides an at least one video camera configured for capturing the activities of each shooter 26 and their associated proxy targets 44, and displaying the footage on an at least one display screen. This not only allows the shooters 26 to re-watch matches after the fact, but also allows them to actively calibrate and confirm proper synchronization of the cover barriers 22 and proxy barriers 24 in situations where the shooters 26 cannot see each other or their respective proxy barriers 24 due to visual obstructions or long distances.

In at least one embodiment, not shown, where the system 20 provides at least two spaced apart cover barriers 22 (and a corresponding number of appropriately positioned proxy barriers 24) for each shooter 26, the system 20 further provides an at least one transition target positioned substantially between the at least two proxy barriers 24 and configured for mimicking (or at least approximating or representing) the shooter's 26 movement between the at least two cover barriers 22. In other words, as the shooter 26 moves from one cover barrier 22 to another cover barrier 22, the transition target would similarly move from one proxy barrier 24 to another proxy barrier 24. In such embodiments, the system may provide an at least one transition sensor positioned and configured for detecting and tracking such movements between cover barriers 22.

In still further embodiments, not shown, the proxy barriers 24 and cover barriers 22 may be omitted altogether, with each of the exposed proxy targets 44 configured for mimicking the movements and position of the associated shooter 26 via the respective sensors 28.

To summarize, regarding the exemplary embodiments of the present invention as shown and described herein, it will be appreciated that a proxy target system, configured for allowing two or more persons to engage in a shootout with one another without any risk of injury or death, is disclosed. Because the principles of the invention may be practiced in a number of configurations beyond those shown and described, it is to be understood that the invention is not in any way limited by the exemplary embodiments, but is generally directed to a proxy target system and is able to take numerous forms to do so without departing from the spirit and scope of the invention. Furthermore, the various features of each of the above-described embodiments may be combined in any logical manner and are intended to be included within the scope of the present invention. It will also be appreciated by those skilled in the art that the present invention is not limited to the particular geometries and materials of construction disclosed, but may instead entail other functionally comparable structure, now known or later developed, without departing from the spirit and scope of the invention.

While aspects of the invention have been described with reference to at least one exemplary embodiment, it is to be clearly understood by those skilled in the art that the invention is not limited thereto. Rather, the scope of the invention is to be interpreted only in conjunction with the appended claims and it is made clear, here, that the inventor believes that the claimed subject matter is the invention.

What is claimed is:

1. A proxy target system for allowing two or more shooters to engage in a shootout with one another, the system comprising:

a plurality of cover barriers, each cover barrier sized and configured for allowing at least one shooter to selectively take cover therebehind;

a plurality of proxy barriers, each proxy barrier being associated with, and positioned a distance away from, a corresponding one of the cover barriers;

each of the cover barriers providing a means for tracking and determining if and when the associated at least one shooter, when positioned behind the cover barrier, should move part or all of his body out from behind the cover barrier; and each of the proxy barriers providing an at least one target positioned therebehind and configured for mimicking the movement and exposure of the at least one shooter relative to the associated cover barrier behind which the shooter is positioned;

whereby, with the proxy barriers positioned a distance downrange from the corresponding cover barriers, two or more shooters may position themselves behind respective cover barriers and engage in a shootout with one another by shooting at each other's downrange targets rather than shooting directly at one another, thereby eliminating any risk of injury or death to the shooters.

2. The proxy target system of claim 1, wherein each means for tracking the associated shooter comprises an at least one sensor positioned on or near the associated cover barrier.

3. The proxy target system of claim 2, wherein the at least one sensor is in communication with an automated controller configured for receiving signals from the sensor related to the position of the shooter relative to the associated cover barrier, wherein the controller is capable of monitoring the position of each shooter, relative to his respective cover barrier, and determining if and when each shooter should expose part or all of his body out from behind his respective cover barrier.

4. The proxy target system of claim 3, wherein the controller is further in communication with each of the targets, the controller being configured for selectively causing each target to mimic the movement and exposure of the at least one shooter relative to the associated cover barrier behind which the shooter is positioned, based on the signals being received from the respective sensors.

5. The proxy target system of claim 4, wherein each sensor is further capable of detecting the distance between the shooter and the respective cover barrier, thereby enabling the controller to cause the associated target to be positioned the same distance away from the corresponding proxy barrier.

6. The proxy target system of claim 1, wherein each proxy barrier is of the same dimensions as the corresponding cover barrier.

7. The proxy target system of claim 1, comprising two or more spaced apart cover barriers and a corresponding number of spaced apart proxy barriers for each shooter.

8. The proxy target system of claim 7, further comprising an at least one transition target positioned substantially between the at least two spaced apart proxy barriers and configured for mimicking the associated shooter's movement between the at least two cover barriers.

9. The proxy target system of claim 8, further comprising an at least one transition sensor positioned and configured for detecting and tracking each shooter's movements between the associated cover barriers.

10. The proxy target system of claim 1, wherein each target is pivotally engaged with a rotatable, articulating, telescoping arm configured for selectively moving the target between exposed and hidden positions.

11. The proxy target system of claim 1, wherein the proxy barrier of each shooter is positioned directly downrange from the cover barrier of the other shooter, thereby allowing each shooter to fire directly downrange at his opposing shooter's proxy target as if he were firing at the opposing shooter himself.

12. The proxy target system of claim 1, wherein each cover barrier is positioned substantially adjacent to one another, with a protective divider wall positioned therebetween, the divider wall configured for both protecting the shooters from any live fire as well as obscuring their view of one another.

13. The proxy target system of claim 1, wherein the system is operable over a network thereby allowing shooters to engage in simulated firefights remotely with one another.

14. The proxy target system of claim 13, wherein the cover barrier of a first shooter and the proxy barrier of an opposing second shooter are positioned in a first location, while the cover barrier of the second shooter and the proxy barrier of the first shooter are positioned in a second location remote from the first location.

15. The proxy target system of claim 1, further comprising:

an at least one microphone positioned proximal each proxy barrier and configured for capturing any sounds created by return fire; and an at least one speaker positioned proximal each cover barrier and configured for audibly reproducing the sounds captured by the microphone positioned proximal the corresponding proxy barrier.

16. The proxy target system of claim 1, wherein each target is configured for automatically moving into the hidden position upon being hit by the opposing shooter.

17. The proxy target system of claim 1, further comprising a means for alerting shooters when a target has been hit.

18. The proxy target system of claim 1, further comprising an at least one video camera configured for capturing the activities of each shooter and their associated at least one target, and displaying the footage on an at least one display screen.

19. A proxy target system for allowing two or more shooters to engage in a shootout with one another, the system comprising:

a plurality of cover barriers, each cover barrier sized and configured for allowing at least one shooter to selectively take cover therebehind;

a plurality of proxy barriers, each proxy barrier being associated with, and positioned a distance away from, a corresponding one of the cover barriers;

each of the cover barriers providing an at least one sensor positioned and configured for determining if and when the associated at least one shooter, when positioned behind the cover barrier, should move part or all of his body out from behind the cover barrier;

each of the proxy barriers providing an at least one target positioned therebehind and configured for mimicking the movement and exposure of the at least one shooter relative to the associated cover barrier behind which the shooter is positioned; and an automated controller in communication with each of the sensors and targets, the controller configured for receiving signals from the sensors, related to the position of the associated shooter relative to the associated cover barrier, and selectively causing the associated targets to move into an appropriate position behind the associated proxy barriers so as to mimic the position of the associated shooter;

whereby, with the proxy barriers positioned a distance downrange from the corresponding cover barriers, two or more shooters may position themselves behind respective cover barriers and engage in a shootout with one another by shooting at each other's downrange targets rather than shooting directly at one another, thereby eliminating any risk of injury or death to the shooters.

20. A proxy target system for allowing two or more shooters to engage in a shootout with one another, the system comprising:

a first cover barrier sized and configured for allowing a first one of the shooters to selectively take cover therebehind;

a second cover barrier sized and configured for allowing a second one of the shooters to selectively take cover therebehind;

each of the first and second cover barriers providing an at least one sensor positioned and configured for determining if and when the associated shooter, when positioned behind the respective cover barrier, should move part or all of his body out from behind the respective cover barrier;

a first proxy barrier positioned a distance directly downrange from the second cover barrier, the first proxy barrier providing an at least one target positioned therebehind and configured for mimicking the movement and exposure of the first shooter relative to the first cover barrier;

a second proxy barrier positioned a distance directly downrange from the first cover barrier, the second proxy barrier providing an at least one target positioned therebehind and configured for mimicking the movement and exposure of the second shooter relative to the second cover barrier;

whereby, with the second proxy barrier positioned a distance downrange from the first cover barrier, and the first proxy barrier positioned a distance downrange from the second cover barrier, the first and second shooters may position themselves behind their respective cover barriers and engage in a shootout with one another by shooting at each other's downrange targets rather than shooting directly at one another, thereby eliminating any risk of injury or death to the shooters.

* * * * *